US005549219A

United States Patent [19]

Lancaster

[11] Patent Number: 5,549,219

[45] Date of Patent: Aug. 27, 1996

[54] METHOD AND APPARATUS FOR COOLING AND PREPARING A BEVERAGE

[76] Inventor: William G. Lancaster, 5101 Upper River Rd., Louisville, Ky. 40222

[21] Appl. No.: 289,672

[22] Filed: Aug. 11, 1994

[51] Int. Cl.[6] ..... B67B 7/00

[52] U.S. Cl. ..... 222/1; 222/129.1; 222/146.6; 62/393

[58] Field of Search ..... 222/1, 146.6, 129.1, 222/129.2, 129.3, 129.4, 318; 62/393, 434

[56] References Cited

U.S. PATENT DOCUMENTS

| | | | |
|---|---|---|---|
| 118,876 | 9/1871 | Myers | 62/396 |
| 140,629 | 7/1873 | Johnson | 222/131 |
| 1,479,595 | 1/1924 | Field | 406/106 |
| 1,503,811 | 8/1924 | Bastian | 239/314 |
| 1,772,111 | 8/1930 | Rice | 222/108 |
| 2,190,084 | 2/1940 | Schlumbohm | 222/1 |
| 2,620,107 | 12/1952 | Tolan | 62/166 |
| 3,044,277 | 7/1962 | Barnum | 62/342 |
| 3,156,103 | 11/1964 | Ross | 62/331 |
| 3,196,625 | 7/1965 | Nicolaus | 62/71 |
| 3,224,641 | 12/1965 | Morgan | 222/129.1 |
| 3,240,395 | 3/1966 | Carver | 222/129.1 |
| 3,369,376 | 2/1968 | Kious | 62/344 |
| 3,378,170 | 4/1968 | Reynolds et al. | 222/129.4 |
| 3,744,263 | 7/1973 | Franck et al. | 62/98 |
| 3,809,292 | 5/1974 | Booth et al. | 222/146 C |
| 3,892,335 | 7/1975 | Schroeder | 222/129.1 |
| 3,930,377 | 1/1976 | Utter | 62/344 |
| 3,998,070 | 12/1976 | Mueller | 62/393 |
| 4,104,889 | 8/1978 | Hoenisch | 62/137 |
| 4,124,145 | 11/1978 | Spinner et al. | 222/56 |
| 4,287,725 | 9/1981 | Hoenisch | 62/344 |
| 4,300,359 | 11/1981 | Koeneman et al. | 62/379 |
| 4,319,698 | 3/1982 | Tomiyama et al. | 222/129.1 |
| 4,555,045 | 11/1985 | Rodth et al. | 222/129.1 |
| 4,742,939 | 5/1988 | Galockin | 222/318 |
| 4,856,678 | 8/1989 | Stanfill et al. | 222/108 |
| 4,964,542 | 10/1990 | Smith | 222/146.6 |
| 5,035,121 | 7/1991 | Cook | 62/389 |
| 5,080,261 | 1/1992 | Green | 222/129.1 |
| 5,115,956 | 5/1992 | Kirschner et al. | 222/146.6 |
| 5,168,714 | 12/1992 | Färber et al. | 62/138 |
| 5,332,123 | 6/1994 | Färber et al. | 222/129.4 |
| 5,353,958 | 10/1994 | Hawkins | 222/146.6 |
| 5,392,960 | 2/1995 | Kendt et al. | 222/146.6 |
| 5,413,742 | 5/1995 | Gatter | 222/146.6 |

FOREIGN PATENT DOCUMENTS

| | | |
|---|---|---|
| 0315439A2 | 5/1989 | European Pat. Off. . |
| 4228775 | 3/1994 | Germany . |
| 4228778A1 | 3/1994 | Germany . |
| 2160503 | 12/1985 | United Kingdom . |

*Primary Examiner*—Andres Kashnikow
*Assistant Examiner*—Lisa Douglas
*Attorney, Agent, or Firm*—Finnegan, Henderson, Farabow, Garrett, and Dunner, L.L.P.

[57] ABSTRACT

Method and apparatus for preparing and dispensing a cool beverage utilizes a heat exchanger for directly contacting water and ice to produce cooled heat exchanger water in the heat exchanger from the water and ice and an outflow of the cooled heat exchanger water. A beverage concentrate flows through a beverage concentrate conduit that is in thermal contact with ice, preferably through direct contact with the cooled heat exchanger water. The beverage concentrate is thus cooled by indirectly contacting the ice to produce an outflow of cooled beverage concentrate. A proportioner and mixer receive the outflow of cooled heat exchanger water and the outflow of cooled beverage concentrate, and proportion and mix the outflows to produce a cool, proportioned, mixed beverage, which is dispensed from a dispensing valve. A carbonator is provided in heat exchange contact with ice, preferably through direct contact with the cooled heat exchanger water, for carbonating the outflow of cooled heat exchanger water to produce a carbonated beverage.

90 Claims, 10 Drawing Sheets

METHOD AND APPARATUS FOR COOLING AND PREPARING A BEVERAGE

BACKGROUND OF THE INVENTION

1. Field of the Invention

The present invention relates to a method and apparatus for cooling and preparing a beverage. Particularly, the present invention includes a method and apparatus for cooling water with ice to produce an outflow of cooled water and for cooling beverage concentrate with ice to produce an outflow of cooled beverage concentrate, and then mixing the two outflows in proper proportion.

2. Description Of Related Art

Beverage dispensers are commonly used in restaurants and convenience stores to mix a beverage concentrate with either carbonated or non-carbonated water, and to cool the mixed beverage. Beverages are typically considered to before refreshing when served cold. Therefore, the quality of the mixed beverage that is produced is at least partially dependent upon the temperature at which the mixed beverage is dispensed. If carbonated water is used, the quality of the mixed beverage is further enhanced by obtaining and maintaining a high level of carbonation in the water, and by minimizing the amount of flashing or foaming that occurs when the carbonated water and beverage concentrate are mixed. Since solubility of carbon dioxide is inversely related to temperature, a high level of carbonation can be obtained and maintained by reducing the temperature of the water prior to carbonation and by maintaining the reduced temperature of the water after carbonation, respectively. Likewise, foaming is minimized by reducing the temperature of the beverage concentrate to a temperature approximately equal to that of the carbonated water prior to mixing.

One of the most popular cooling devices to date is referred to as a cold plate. A cold plate conventionally includes a large block of aluminum, perhaps 20 inches square and 4 inches high. Mounted within the aluminum block are a series of horizontally coiled stainless steel tubes or other conduits stacked vertically above each other. Each stainless steel tube respectively carries a different liquid, such as water or a beverage concentrate. If carbonation is desired, a separate carbonator is provided.

To cool the liquids, ice is provided in contact with the upper surface of the cold plate while each of the different liquids for the beverage are flowed through a respective tube. The melt runoff from the ice is drained and discarded.

Hence, the water and beverage concentrates are cooled by heat transfer through the walls of the stainless steel tube and the aluminum block. After passing through the cold plate, the water and a selected beverage concentrate are mixed in proper proportion and dispensed from a dispensing valve located downstream of the cold plate. The cold plate is often provided in the bottom of a large container or tank that is mounted in or on a counter top. The cold plate provided an advance over prior arrangements which cooled water and beverage concentrates by flowing those fluids through unencased conduits in an ice water bath.

Although the cold plate may adequately cool the water and beverage concentrate, it is an expensive and heavy component. These high costs are partially due to the quantity of aluminum required to construct the large solid block, as well as the complexity of fabricating a series of tubes within the block while ensuring that no leaks occur. The size and weight of the cold plate also increases costs and difficulty in constructing, handling, and shipping dispensers using this cooling system.

The cold plate also has cooling inefficiencies. The efficiency of the cold plate is inherently dependent upon the heat transfer rate between the ice and the liquid to be cooled. Therefore, when the concentrate tubes are encased in the aluminum block, several walls of aluminum and stainless steel separate the ice and the liquid to be cooled, and the heat transfer rate decreases accordingly. Hence, the tube located closest to the upper surface of the cold plate will be cooled most, while the tube located furthest from the upper surface will be cooled least. In view of this, the liquid required most, which is typically carbonated or non-carbonated water, is prearranged to flow through the top tube of the cold plate, while the liquid required least flows through the bottom tube of the cold plate.

Since only a limited length of tubing can extend through the cold plate, efficiency also is dependent upon the duration in which the liquid to be cooled is held within the cold plate. During periods of peak demand, it is evident that the liquid, particularly carbonated or non-carbonated water, will pass through the cold plate much more quickly than during periods of low or casual demand. Therefore, the duration in which the liquid passes through the cold plate during peak demand may be inadequate for sufficient cooling to occur. There also can be a cooling problem when demand is low. The liquid that has already passed through the cold plate and is held in the portion of the tube between the cold plate and dispensing valve will not remain cooled for an extended period of time. Therefore, drinks dispensed during periods of casual demand often are unsatisfactorily cooled.

An additional concern related to the cold plate is the adverse impact on the environment due to draining and discarding of the melt runoff from the ice or ice/water mixture. Severe droughts and water shortages are recurring throughout numerous areas of the country and the world. Since beverage dispensers are so widely used, the melt runoff discarded by beverage dispensers significantly wastes a valuable natural resource.

Another conventional cooling apparatus is referred to as a counter electric. The counter electric utilizes refrigeration to freeze water surrounding a series of tubes, each carrying a different liquid to be cooled. However, this device must rely on a refrigeration unit and is not capable of dispensing ice into the drink in the typical commercial manner.

As such, there remains a need for a method and apparatus for more efficiently cooling, preparing, and dispensing a cool beverage without wasting water and electricity. Additionally, there remains a need for reducing the cost, size, and weight of an apparatus for cooling, preparing, and dispensing a cool beverage.

SUMMARY OF THE INVENTION

The advantages and purpose of the invention will be set forth in part in the description that follows, and in part will be obvious from the description, or may be learned by practice of the invention. The advantages and purpose of the invention will be realized and attained by means of the elements and combinations particularly pointed out in the appended claims.

To achieve these advantages and in accordance with the purpose of the invention, as embodied and broadly described herein, the present invention includes a method and apparatus for cooling, preparing, and dispensing a cool beverage by directly contacting water and ice, cooling the water and melting the ice, to produce cooled heat exchanger water in the heat exchanger from the water and ice and an outflow of the cooled heat exchanger water. In addition, beverage concentrate is flowed through a conduit in thermal contact with ice or cooled heat exchanger water, indirectly contacting the beverage concentrate with the ice or cooled heat exchanger water, to cool the beverage concentrate and produce an outflow of the cooled beverage concentrate. A proportioner and mixer receive the outflow of cooled heat exchanger water and the outflow of cooled beverage concentrate, and proportion and mix the outflows to produce a cool, proportioned, mixed beverage. A dispensing valve controls the dispensing of the cool, proportioned, mixed beverage.

It is preferable to automatically maintain sufficient amounts of water and ice in the heat exchanger to maintain the outflow of cooled heat exchanger water at a substantially constant temperature independent of the rate of outflow. If carbonated beverages are to be produced, a carbonator is provided for carbonating the outflow of cooled heat exchanger water. The carbonator preferably is in heat exchange contact with the ice or the cooled heat exchanger water for keeping the contents of the carbonator cool, and includes means for recirculating carbonated water from the carbonator. Also preferably included are an agitator for agitating the water and ice in the heat exchanger, and an ice storage bin communicable with the heat exchanger for supplying ice to the heat exchanger.

In accordance with one aspect of the invention, the beverage concentrate conduit is positioned within the heat exchanger in direct contact with the cooled heat exchanger water. In accordance with another aspect of the invention, the heat exchanger is configured to prevent the beverage concentrate conduit from directly contacting the cooled heat exchanger water that is to be outflowed and mixed with the cooled beverage concentrate.

It is to be understood that both the foregoing general description and the following detailed description are exemplary and explanatory only and are not restrictive to the invention, as claimed.

The accompanying drawings, which are incorporated in and constitute a part of the specification, illustrate embodiments of the invention and together with the description, serve to explain the principles of the invention.

DESCRIPTION OF THE PREFERRED EMBODIMENTS

Reference will now be made in detail to a present preferred embodiment of the invention, an example of which is illustrated in the accompanying drawings. Wherever possible, the same reference numbers will be used throughout the drawings to refer to the same or like parts.

Figure 1:
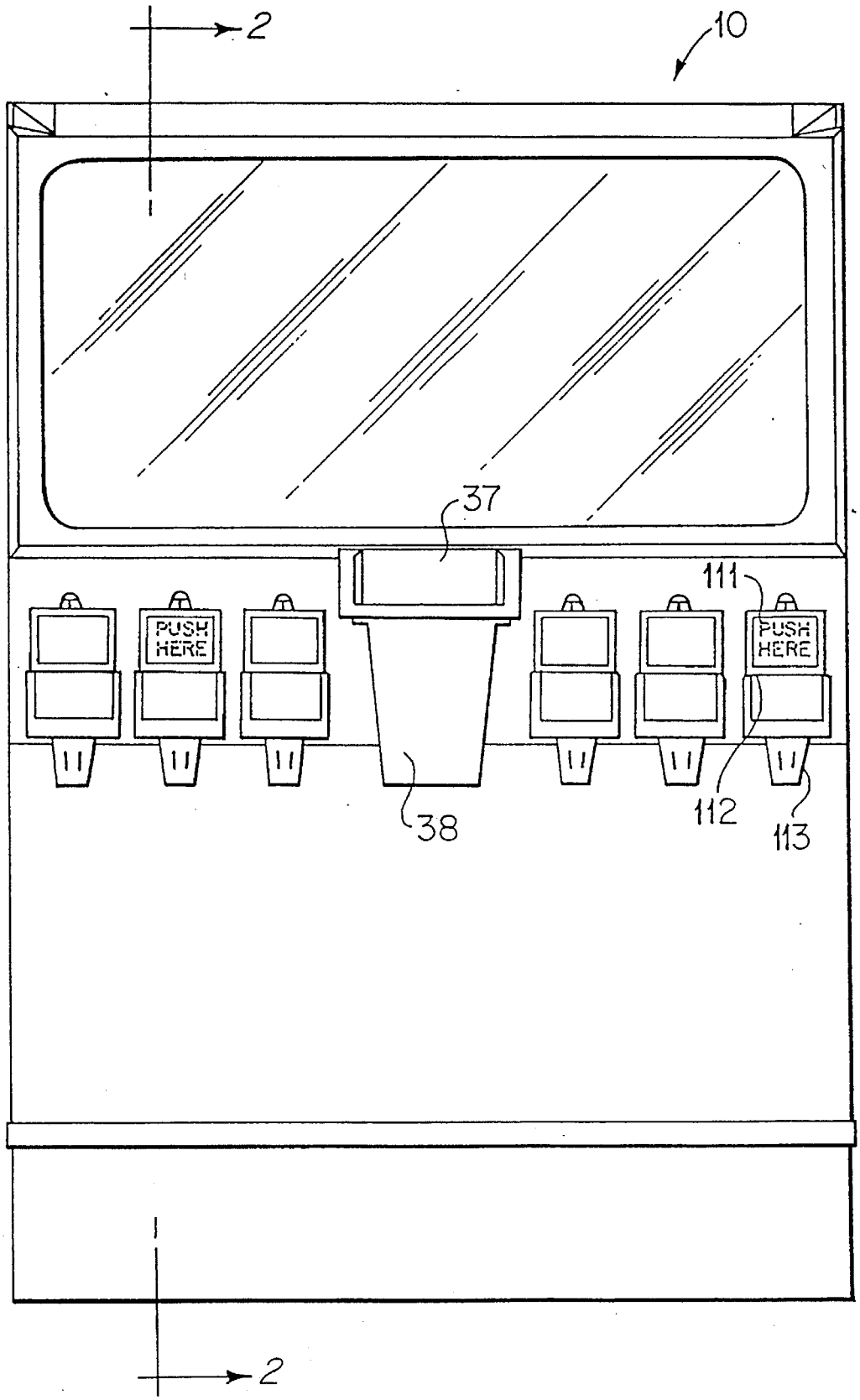
FIG. 1 is a front view of an exemplary embodiment of an apparatus for cooling, preparing, and dispensing a beverage in accordance with the present invention

In accordance with the present invention, a method and apparatus are provided for cooling, preparing, and dispensing a cool beverage. Particularly, the method and apparatus of the present invention use ice to directly cool water and indirectly cool a beverage concentrate, and mix the cooled water and the cooled beverage concentrate in proper proportion to prepare a cool, proportioned, mixed beverage. This cool, proportioned, mixed beverage is dispensed from the apparatus for subsequent consumption. An exemplary embodiment of the ice driven system provided by the present invention is illustrated in an arrangement that is supported on a counter top and is shown in FIG. 1, as designated generally by reference character 10, for purpose of explanation and illustration, and not limitation. The steps of the method will be described in conjunction with and by reference to the operation of the apparatus.

In accordance with the present invention, water and ice are directly contacted together in a heat exchanger so as to cool the water and melt the ice, enhancing and optimizing the heat transfer rate between the ice and water, and efficiently using the cold melt runoff of the ice and saving about 80–95% of the melt water that is currently discarded in commercially used machines. Together, the water and the ice produce cooled heat exchanger water in the heat exchanger, and an outflow of the cooled heat exchanger water.

The quality of the resulting outflow of cooled heat exchanger water also is enhanced by this process. Typically, commercial ice is more pure than tap water since distillation and purification occurs during freezing. Also, commercial ice makers may distill and purify water prior to freezing to improve quality. The melt runoff from the ice therefore is likely to be more pure than the tap water that is provided in the heat exchanger. The purer melt runoff thus dilutes the impurities of the tap water when the two combine to produce the cooled heat exchanger water. The outflow of cooled heat exchanger water ultimately is mixed with beverage concentrate to produce a cool, proportioned, mixed beverage.

As shown in FIGS. 2 through 5, the heat exchanger 50 embodied herein includes a heat exchanger tank 52 for maintaining the water and ice in direct contact. Preferably, the walls of the heat exchanger tank 52 are made of or coated with a thermal insulative material to avoid unnecessary heat or energy loss. The heat exchanger tank 52 is sufficiently sized or dimensioned to satisfy the expected demand required for the outflow of cooled heat exchanger water. Likewise, the heat exchanger tank 52 is shaped and sufficiently sized or dimensioned to allow this outflow of heat exchanger water to reach a desired temperature. These shapes and dimensions therefore will be, at least partially, dependent upon the intended use and demand of the apparatus.

An ice inlet 42 is located in an upper portion of the heat exchanger tank 52. By locating the ice inlet 42 in the upper portion of the heat exchanger tank 52, constant loading of the ice can be ensured since blockage of the inlet is unlikely until the heat exchanger tank 52 is full. An ice level sensor 43 is also provided to ensure that a sufficient amount of ice is maintained in the heat exchanger tank 52 throughout operation.

An ice transfer system includes an ice bin 20 located adjacent to and communicable with the heat exchanger tank 52, and an ice transfer for delivering ice from the ice bin 20 to the ice inlet 42 of the heat exchanger tank 52. The ice bin 20 preferably is loaded by an ice making machine (not shown) mounted on top. Alternatively, the ice may be loaded manually. To reduce volume and construction costs, the ice bin 20 is integrally fabricated with the heat exchanger 50 so as to share a common wall. The ice bin 20 preferably includes a runoff tube 21 that permits the melt runoff from the ice bin to be drained and discarded.

The ice transfer shown in FIGS. 2 through 7 includes a paddle wheel 30 mounted on a rotatable shaft 32, which is driven by a motor 34. Around the circumference of the paddle wheel 30 is a continuous series of compartments 31, each sized to carry at least one ice cube. As the paddle wheel 30 is rotated by the motor 34, separate ice cubes are captured in the compartments 31 and transferred to an ice dump 36 in communication with the ice inlet 42. Ice is thus constantly retrieved from the bottom of the ice bin 20 and transferred upward. The paddle wheel 30 continues to rotate and deliver ice until the ice level sensor 43 transmits a signal to the motor 34 that the desired ice level is reached. Hence, the ice level sensor 43 may include a toggle switch or a timer for controlled ice transfer.

This ice transfer system also may be used to deliver ice to the ice door 39 of an ice dispenser 38 for dispensing ice cubes on demand. The ice dispenser 38 includes a switch, such as a toggle switch connected to the ice door 39 or a separate button switch to be pushed by an operator. The switch 37, shown in FIG. 1, transmits a signal to the motor 34 to activate the paddle wheel 30. The ice dump 36 of the heat exchanger and the ice door 39 of the ice dispenser 38 are positioned at different locations. Further, if the heat exchanger 50 includes more than on tank, as will be described below, the ice transfer is configured to deliver ice to a separate ice dump 36 corresponding to an ice inlet 42 for each heat exchanger tank. By using the ice transfer system, ice is consistently available when required. Alternatively, ice can be made by using a counter electric, so that in either of these arrangements, ice provides the storage mechanism for refrigeration and the source of cooling.

The heat exchanger 50 also includes a water inlet 62 from an outside source 61, such as a tap water source. The water inlet 62 likewise is preferably located in the upper portion of the heat exchanger tank 52. In this manner, the risk of blockage due to excessive ice accumulation is minimized by locating the water inlet 62 in the upper portion of the heat exchanger tank 52. Further, any ice accumulation that does occur around either the water inlet 62 or the ice inlet 42 is effectively removed by the jet stream action of the water introduced through the water inlet 62.

The preferred location of the water inlet 62 also allows the water that is introduced to directly contact a greater amount of ice, and thus enhance efficiency. Water introduced in the upper portion of the heat exchanger tank 52 will seek the bottom of the heat exchanger tank 52 due to gravity. Hence, the height of the heat exchanger 50 can be configured to direct the water along a path of sufficient length so as to be in contact with the ice a sufficient time to produce an outflow of cooled heat exchanger water at or below a desired temperature. In the preferred embodiment of the invention, this desired temperature is at or below about 38° F., and more preferably at or below about 36° F., to enhance the quality of the beverage that is dispensed.

Figure 2:
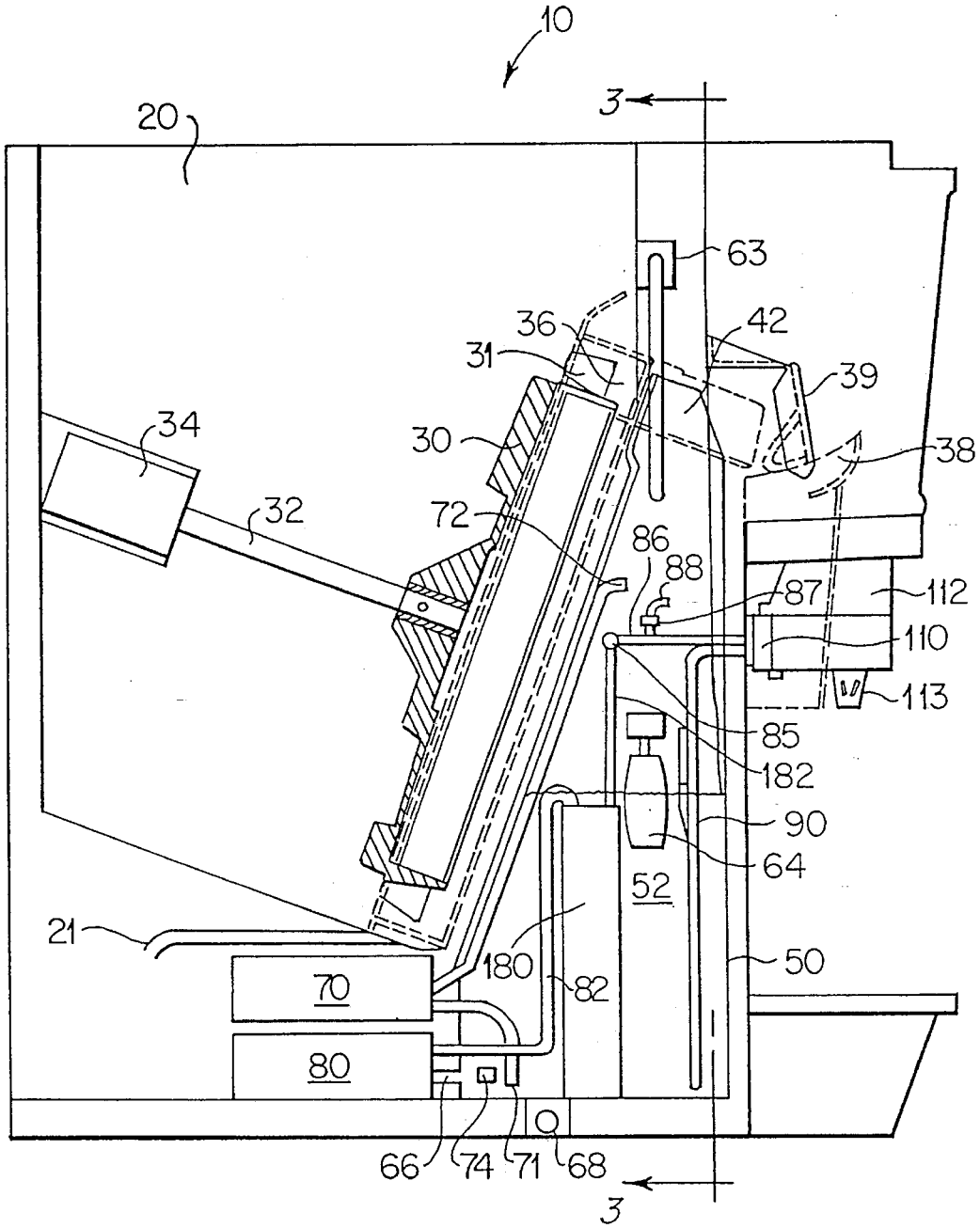
FIG. 2 is a sectional side view of the apparatus of the present invention taken along line 2—2 of FIG. 1.
Figure 3:
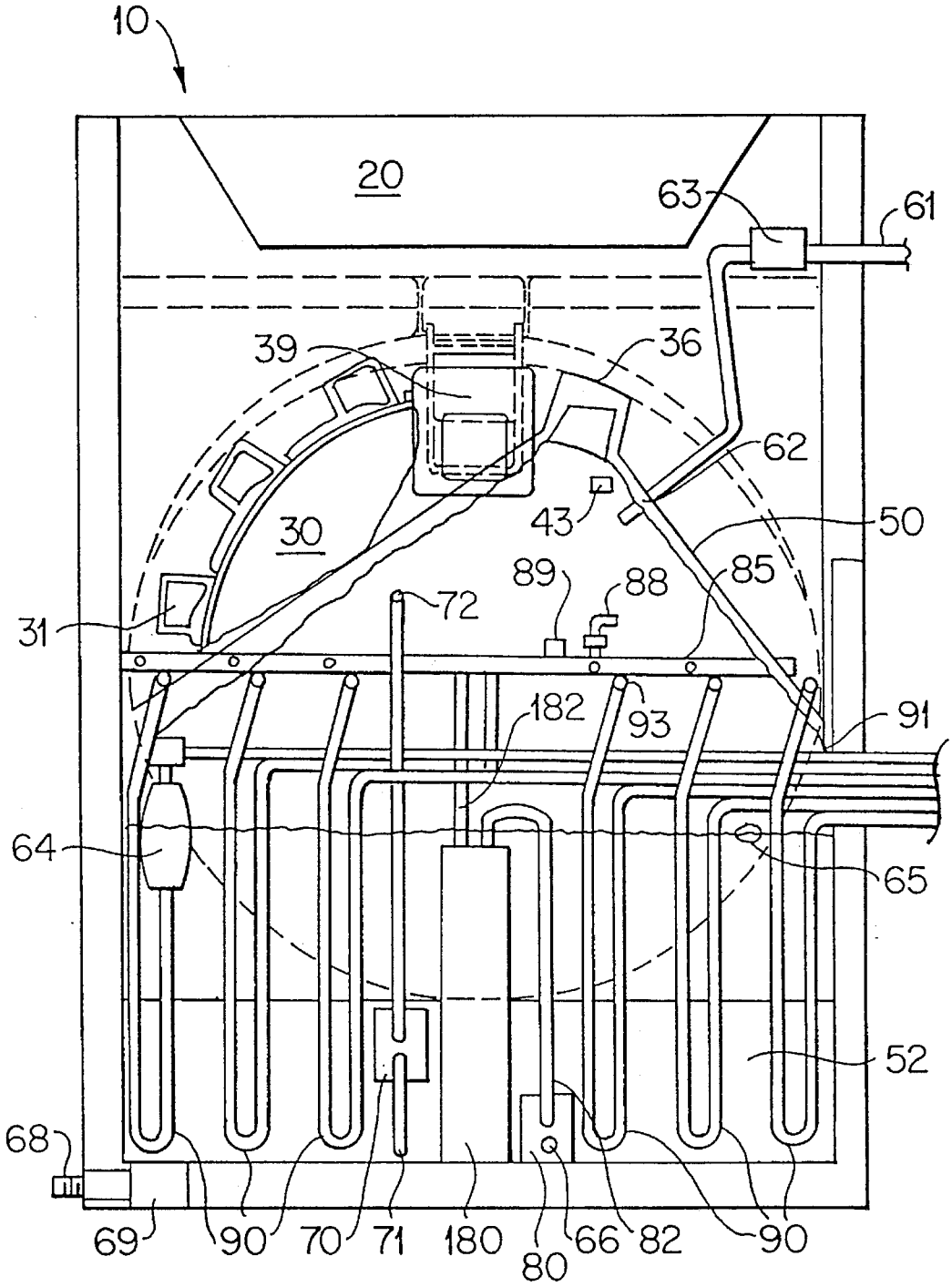
FIG. 3 is a sectional front view of the apparatus of the present invention taken along line 3—3 of FIG. 2.

Alternatively, when space constraints limit the available height of the heat exchanger 50, the flow path of the water can be effectively extended to the known length required for producing the desired temperature by using an agitator. The agitator recirculates the water over the ice within the heat exchanger tank 52 until sufficient flow path length is effectively reached. As shown in FIGS. 2 and 3, the agitator may include a conventional recirculation pump 70 that draws water through an intake 71 from the lower portion of the heat exchanger tank 52 and recirculates it through a recirculation line 72 to the upper portion of the heat exchanger tank 52. Similarly, the agitator may be used to speed the water cooling process by accelerating contact between the ice and the water, or in conjunction with a thermistor 74 to recirculate water that exceeds a predetermined temperature, as will be described.

Figure 6:
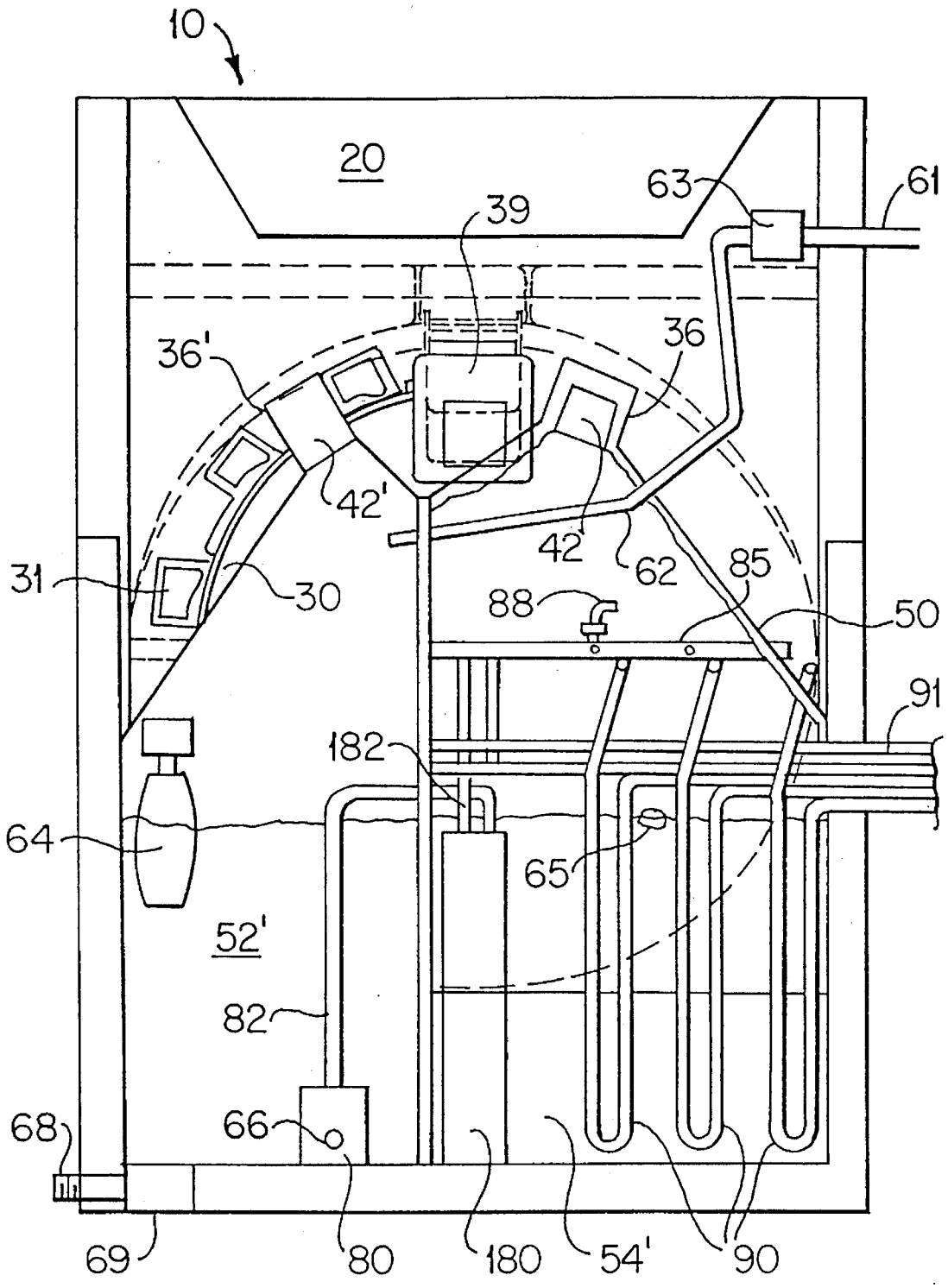
FIG. 6 is a sectional front view of an exemplary embodiment of an apparatus in accordance with another aspect of the present invention.

To ensure that a sufficient amount of water is in direct contact with the ice, a water level sensor 64 is also provided within the heat exchanger 50. The water level sensor 64 is connected to a water inlet valve 63 that is located at the water inlet 62 to automatically maintain a desired water level within the heat exchanger tank 52. A water level relief outlet 65 also may be provided to prevent the desired water level from being exceeded as shown in FIG. 6.

By providing the ice level sensor 43 and the water level sensor 64, a control system may be used to automatically maintain sufficient water and ice in the heat exchanger 50 to maintain the outflow of cooled heat exchanger water at a substantially constant temperature, preferably at or below about 36° F. The control system may include the proper combination of a toggle switch or timer that operates as the ice level sensor and controls the supply of ice, and a float valve that operates as the water level sensor and controls the water inlet valve 63. Alternatively, more sophisticated electronic equipment may be used if desired. Thus, a substantially constant temperature of the cooled heat exchanger water may be maintained independent of the rate of outflow, particularly when a recirculation pump is provided. This enhances the coldness of the drink for both the casual draw and high demand draw.

Since ice is less dense than water and will float, it is also preferred that the water level is controlled so ice may be distributed to the lower portion of the heat exchanger tank 52. That is, ice will continue to float on top of the water if insufficient space is available to build up a significant mass of ice to sink to the lower portion of the heat exchanger tank 52. The water level is therefore preferably maintained at approximately one half the height of the heat exchanger tank 52.

A water outlet 66 is located at the lower portion of the heat exchanger tank 52 for the outflow of cooled heat exchanger water. The outflow of cooled heat exchanger water from this water outlet 66 is used for producing the mixed beverage to be dispensed. The apparatus embodied herein utilizes a water pump 80 to draw the outflow of cooled heat exchanger water through the water outlet 66 and into an intake of the water pump 80. Preferably, a water line 82 is connected to the water pump 80 and extends within the heat exchanger 50 for subsequent distribution and discharge of the outflow of cooled heat exchanger water through a water manifold 85, as will be described. By maintaining the water line 82, and thus the outflow of cooled heat exchanger water, within the heat exchanger 50, unnecessary exposure and warming of the outflow of cooled heat exchanger water will be minimized.

As previously mentioned, a thermistor 74 and recirculation line 72 also are preferably connected to or located proximate the water outlet 66 to ensure that the outflow of cooled heat exchanger water does not exceed a predetermined temperature. If the predetermined temperature is exceeded, a recirculation pump 70 is activated by a signal from the thermistor 74 to recirculate the outflow of cooled heat exchanger water to the upper portion of the heat exchanger tank 52 for additional circulation and cooling. FIGS. 2 and 3 show that a thermistor 89 and manifold recirculation valve 87 likewise are provided on the water manifold 85 to recirculate water from the water manifold 85 when a predetermined temperature is exceeded, such as during periods of low or casual demand. Alternatively, an orifice (not shown) may be provided in the water manifold 85 for recirculating water at a low constant flow so as to prevent undesirable warming of the water in the water manifold 85 during periods of low demand.

Also located at the lower portion of the heat exchanger tank 52 of the apparatus embodied herein is a drain 68 and dump valve 69. For example, when the temperature in the heat exchanger tank 52 is unacceptable due to a lack of ice, the dump valve 69 is actuated by a signal from the thermistor 74 to purge the water contained within the heat exchanger tank 52. The dump valve 69 is closed after purging is completed and, after new ice is introduced, the control system described above produces the desired temperature of cooled heat exchanger water.

Further in accordance with the present invention, beverage concentrate is flowed through a beverage concentrate conduit that thermally contacts ice. In this manner, the beverage concentrate that flows through the beverage concentrate conduit indirectly contacts the ice so as to cool the beverage concentrate and produce an outflow of undiluted cooled beverage concentrate. According to one aspect of the present invention, the beverage concentrate conduit is positioned to be directly contacting the cooled heat exchanger water, namely the water that is to be mixed with the cooled beverage concentrate. This provides a highly efficient and compact unit. The outflow of cooled beverage concentrate is then mixed with a proper proportion of the outflow of cooled heat exchanger water to produce the cool, proportioned, mixed beverage, as will be described.

The beverage concentrate conduit preferably includes a plurality of beverage concentrate conduits, each beverage concentrate conduit flowing a respective beverage concentrate and thermally contacting ice. In this manner, a plurality of respective beverage concentrates indirectly contact ice for simultaneous cooling of the beverage concentrates. This arrangement allows an outflow of a selected cooled beverage concentrate to be produced simply by selectively flowing the desired beverage concentrate through the respective beverage concentrate conduit. Further, and in contrast with the stacked tube arrangement of a conventional cold plate, this arrangement allows the outflow of each cooled beverage concentrate to have a temperature approximately equal to that of the other beverage concentrates. That is, the temperatures of the various outflows of cooled beverage concentrate preferably are within about 4° F. of each other, and more preferably within about 2° F. of each other.

As shown in FIGS. 2 through 5, a plurality of beverage concentrate conduits 90 for flowing a respective plurality of beverage concentrates are disposed within the heat exchanger tank 52. The conduits 90 are preferably tubes or tubular members, however, for purposes of the present invention, the beverage concentrate conduits may be any arrangement which contains or permits the flow of beverage concentrate during the time the beverage concentrate is being cooled. The beverage concentrates can include flavors such as cola, ginger ale, and orange. A conduit inlet 91 into the heat exchanger 50 and a conduit outlet 93 out of the heat exchanger 50 are provided for each beverage concentrate conduit 90. The conduit inlet 91 and outlet 93 of each beverage concentrate conduit 90 are preferably located above the water level in the heat exchanger tank 52 to eliminate the risk of leakage through the wall of the heat exchanger tank 52. Between the conduit inlet 91 and outlet 93, each beverage concentrate conduit 90 directly contacts the cooled heat exchanger water by extending below the water level that is maintained in the heat exchanger tank 52 for indirect contact of the respective beverage concentrate with the cooled heat exchanger water. Couplings or quick release connections may be provided at the conduit inlet 91 and outlet 93 of each beverage concentrate conduit 90 to facilitate easy removal and cleaning.

Although FIGS. 2 through 5 show each beverage concentrate conduit 90 generally having a coiled U-shaped configuration between the conduit inlet 91 and outlet 93, alternative configurations also may be used. For example, a spirally stacked coil shape could be used to significantly increase the length of the beverage concentrate conduit 90 that is in contact with the cooled heat exchanger water, and thus, the indirect exposure and cooling of the beverage concentrate. The beverage concentrate conduits 90 therefore can be arranged so as to indirectly contact each respective beverage concentrate with the cooled heat exchanger water for a sufficient time to maintain the outflow of beverage concentrate at or below a desired temperature.

In the preferred embodiment of the present invention, the desired temperature for the outflow of beverage concentrate is at or below about 40° F. and more preferably at or below about 38° F., so as to enhance the quality of the beverage that is dispensed. However, to minimize flashing or foaming when the beverage concentrate is mixed with carbonated water, it is preferred that the temperature difference between the two liquids does not exceed about 4° F., and more preferred that the temperature difference does not exceed 2° F. Therefore, when the carbonated water is cooled to a temperature at or below about 36° F., it is preferred that the beverage concentrate is cooled to a temperature at or below about 38° F. This may be accomplished using a preferred length of about 18 feet of beverage concentrate conduit 90 for each beverage concentrate. However, if additional cooling of the beverage concentrate is required, a greater length of beverage concentrate conduit 90 can be used. Unlike a conventional cold plate configuration, the present invention is less limited in the length of beverage concentrate conduit that is available for cooling.

Further, this arrangement preferably uses single-walled unencased tubes or tubular members for the beverage concentrate conduits 90, as opposed to tubes that are encased in an aluminum block such as the arrangement used in the cold plate system described above. In contrast to a conventional cold plate, the outer surface of each tubular member preferably embodied herein is unobstructed from direct contact with the cooled heat exchanger water. Hence, the outer surface of each tubular member directly contacts cooled heat exchanger water, while the inner wall of each tubular member directly contacts the respective beverage concentrate flowing therethrough. The tubular members preferably have thin walls, such that the wall thickness is about 0.020 inches, for enhanced heat transfer. The tubular members of the beverage concentrate conduits 90 are usually fabricated from stainless steel. Alternatively, encased conduit units such as cold plates may be used, if necessary or desired, to cool the beverage concentrate by indirectly contacting the beverage concentrate with ice.

According to further aspect of the present invention and as shown in FIG. 6, the heat exchanger 50 is configured to include a second tank 54' for directly contacting ice and water with the beverage concentrate conduits to produce an outflow of cooled beverage concentrate, while preventing the water and ice in the second tank 54' of the heat exchanger 50 from mixing with the cooled heat exchanger water of the first tank 52'. This is accomplished by positioning and disposing the beverage concentrate conduits 90 in the second tank 54', and by separately draining and discarding the melt runoff from the second tank 54'. Hence, the cooled heat exchanger water from the first tank 52' of the heat exchanger 50, which is used for producing the mixed beverage, does not contact the beverage concentrate conduits 90. Preferably, the first tank 52' is configured for easy removal and cleaning. It is also preferred that such components as the water lines 82, 86, and the water manifold 85 are provided in the second tank 54' of the heat exchanger 50. This limits the number of components that are exposed within the first tank 52' of the heat exchanger 50 and simplifies maintaining the purity of the outflow of cooled heat exchanger water therefrom which is mixed with the cooled beverage concentrate. This may be particularly useful in concentrate cooling systems that are less frequently cleaned.

As with the first aspect described above, the walls of the second tank 54' of the heat exchanger 50 preferably are made of or coated with a thermal insulative material. FIG. 6 shows that the first and second tanks 52', 54' of the heat exchanger 50 can share a common wall to reduce costs related to fabrication and materials, as well as to reduce the size and weight of the apparatus as a whole. Also similar to the first aspect described above, the beverage concentrate conduits 90 and tanks 52', 54' may be manufactured using a variety of configurations and materials. Alternatively, an orifice with a removable plug may be positioned between the tanks to provide a choice of whether to mix the water between the two tanks.

Figure 7:
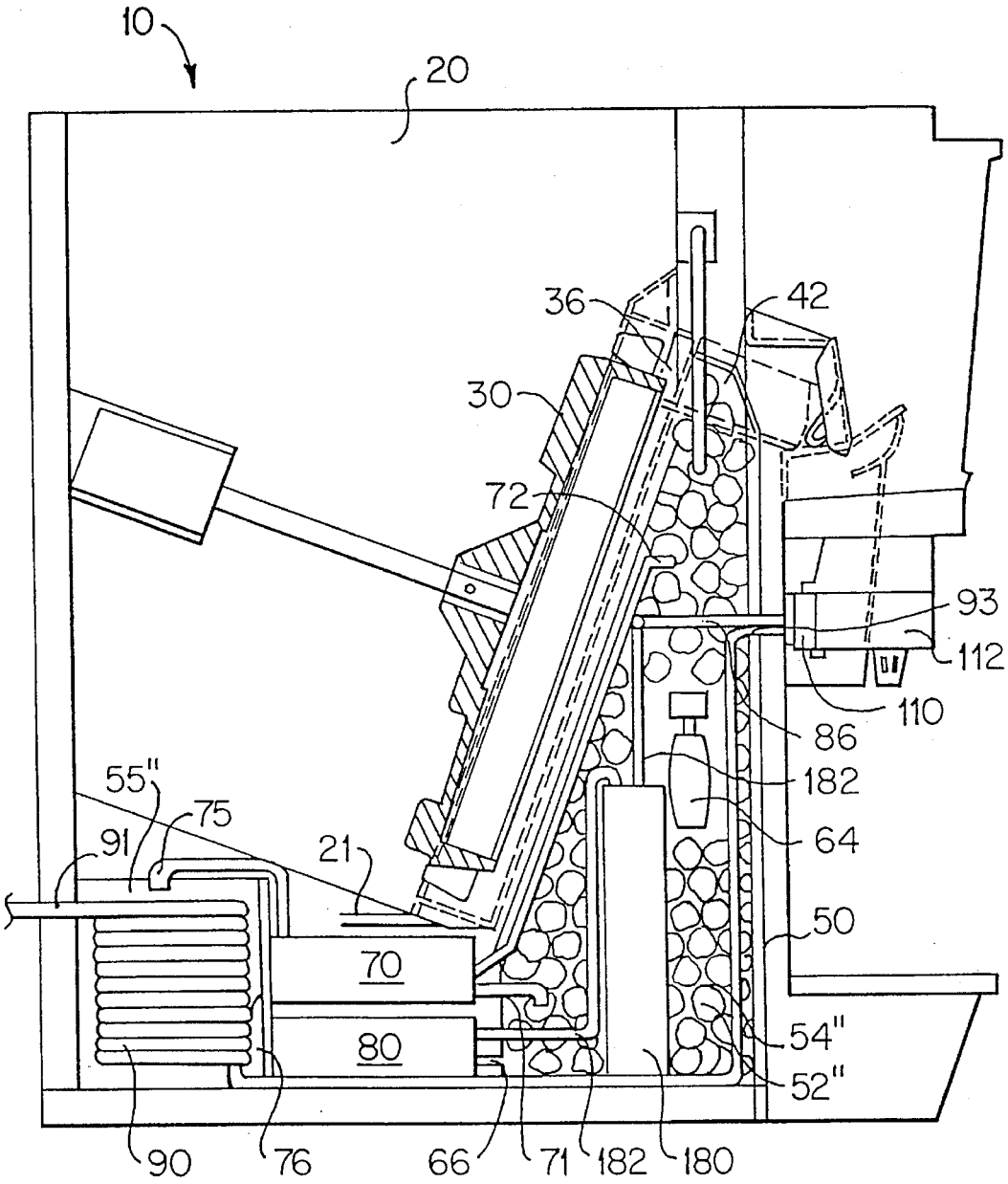
FIG. 7 is a sectional side view of an exemplary embodiment of an apparatus in accordance with a further aspect of the present invention.

In accordance with another aspect of the present invention, the heat exchanger 50 can be provided with an additional tank 55" for directly contacting the beverage concentrate conduits 90 with cooled heat exchanger water only. For example, and as shown in FIG. 7, a first heat exchanger tank 52" is provided for directly contacting water and ice to produce cooled heat exchanger water, as described above. A second heat exchanger tank 54" optionally may be provided in the same manner as discussed above. An additional heat exchanger tank 55" is provided for directly contacting beverage concentrate conduits 90 with a portion of the cooled heat exchanger water produced. A communication line 75 is connected to the recirculation pump 70 to cycle a portion of the cooled heat exchanger water through an intake 71 from the bottom of the first tank 52" or from second tank 54" to the top of the additional tank 55". With the beverage concentrate conduits 90 positioned and disposed in the additional tank 55", the cooled heat exchanger water that is cycled to the additional tank 55" effectively provides thermal contact with the ice in the first tank 52" or second tank 54". The portion of cooled heat exchanger water in the additional tank 55" is agitated and recycled back to tank 52" or tank 54" by the recirculation pump 70 for continued cooling through a connecting tube 76.

In this manner, all of the beverage concentrate conduits 90 may be located in the additional tank 55" for maintaining the purity of the outflow of cooled heat exchanger water from the first tank 52". Alternatively, beverage concentrate conduits 90 can be located in both the first tank 52" and the additional tank 55", or in both the second tank 54" and the additional tank 55", to increase the number of beverage concentrates that can be cooled, and thus, the number of beverages that can be dispensed from the apparatus.

As described, the various embodiments of the present invention sometimes utilize more than one heat exchanger tank. In some instances, this is to keep the ice and water which contacts and cools the beverage concentrate conduits in a separate tank from the tank containing the water to be consumed. In other instances, this is to cycle cooled water from an ice water tank to an additional tank where the cooled water cools the beverage concentrate conduits. In yet other instances, a first tank contains ice and the water that is consumed, a second tank contains ice and water and primary beverage concentrate conduits, and an additional tank contains secondary beverage concentrate conduits and receives cooled water from the first or second tank.

Figure 4:
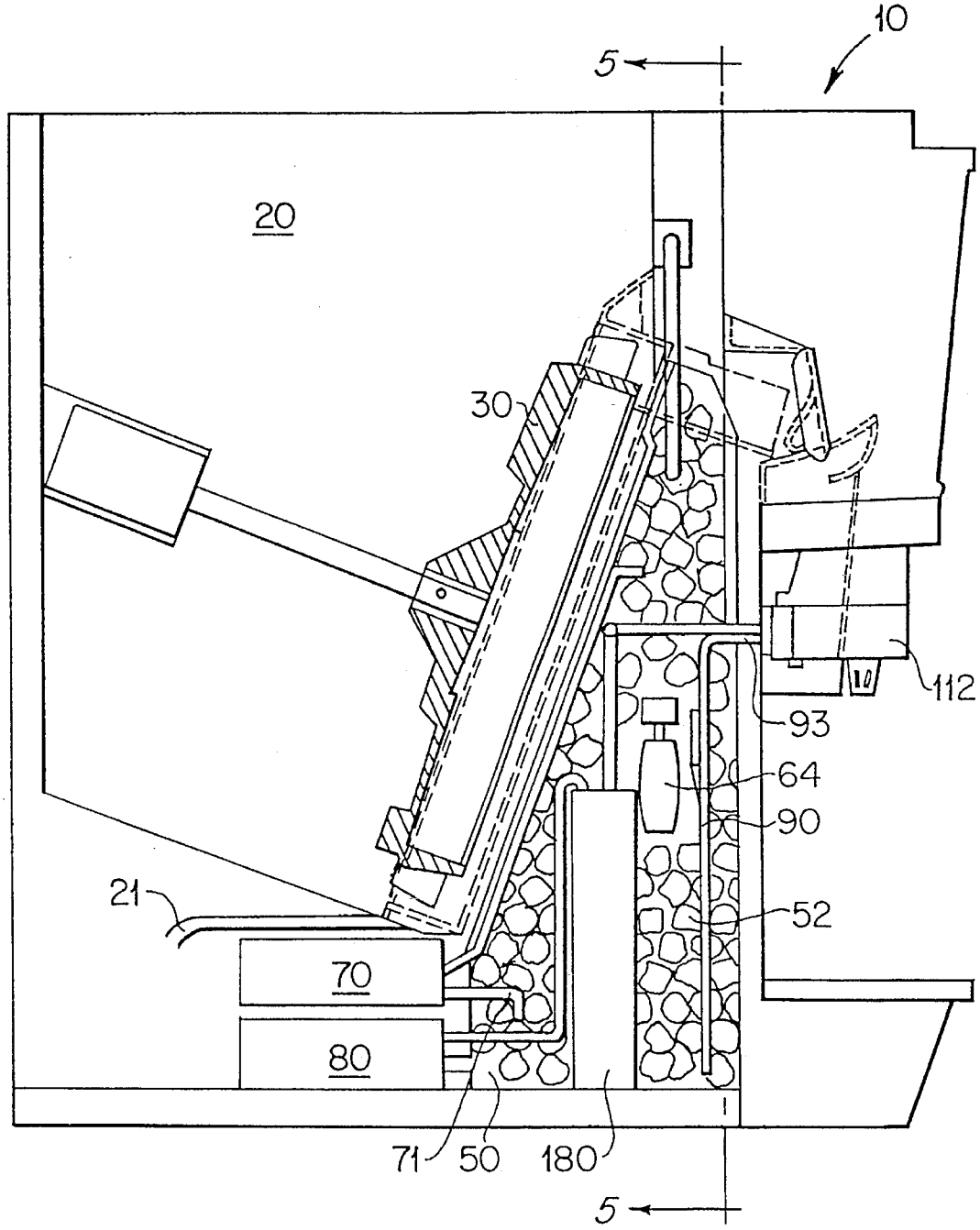
FIG. 4 is the sectional side view of the apparatus of the present invention as shown in FIG. 2, wherein the apparatus is in operation.
Figure 5:
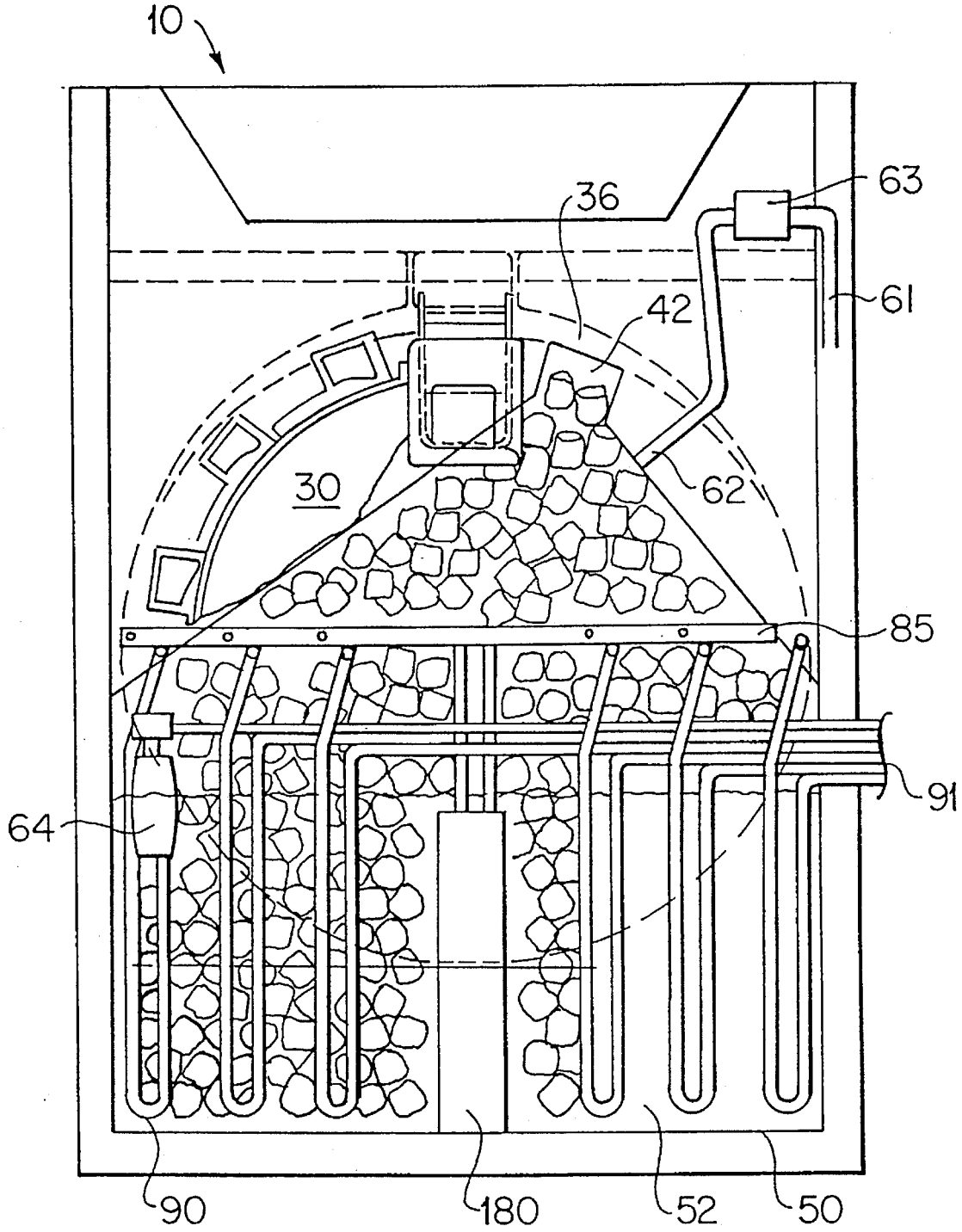
FIG. 5 is the sectional front view of the apparatus of the present invention as shown in FIG. 3, wherein the apparatus is in operation.

In each of the arrangements shown in FIGS. 1 through 7, it is preferred that the conduit outlet 93 of each beverage concentrate conduit 90 is located immediately behind a corresponding dispensing valve 112. Similarly, a separate water discharge line 86 for each beverage concentrate conduit 90 extends from the water manifold 85 and exits the heat exchanger 50 at a location proximate the conduit outlet 93 of the corresponding beverage concentrate conduit 90. Although these conduits 90 and discharge lines 86 are above the heat exchanger water level, FIGS. 4 and 5 show that they remain surrounded by ice when the apparatus is in operation. By arranging the beverage concentrate conduits 90 and water discharge lines 86 to exit the heat exchanger 50 immediately behind corresponding dispensing valves 112, the duration in which the outflow of cooled heat exchanger water and the outflow of cooled beverage concentrate are not cooled within the heat exchanger is minimized, and the efficiency of the apparatus in dispensing cool beverage is further enhanced.

Figure 8:
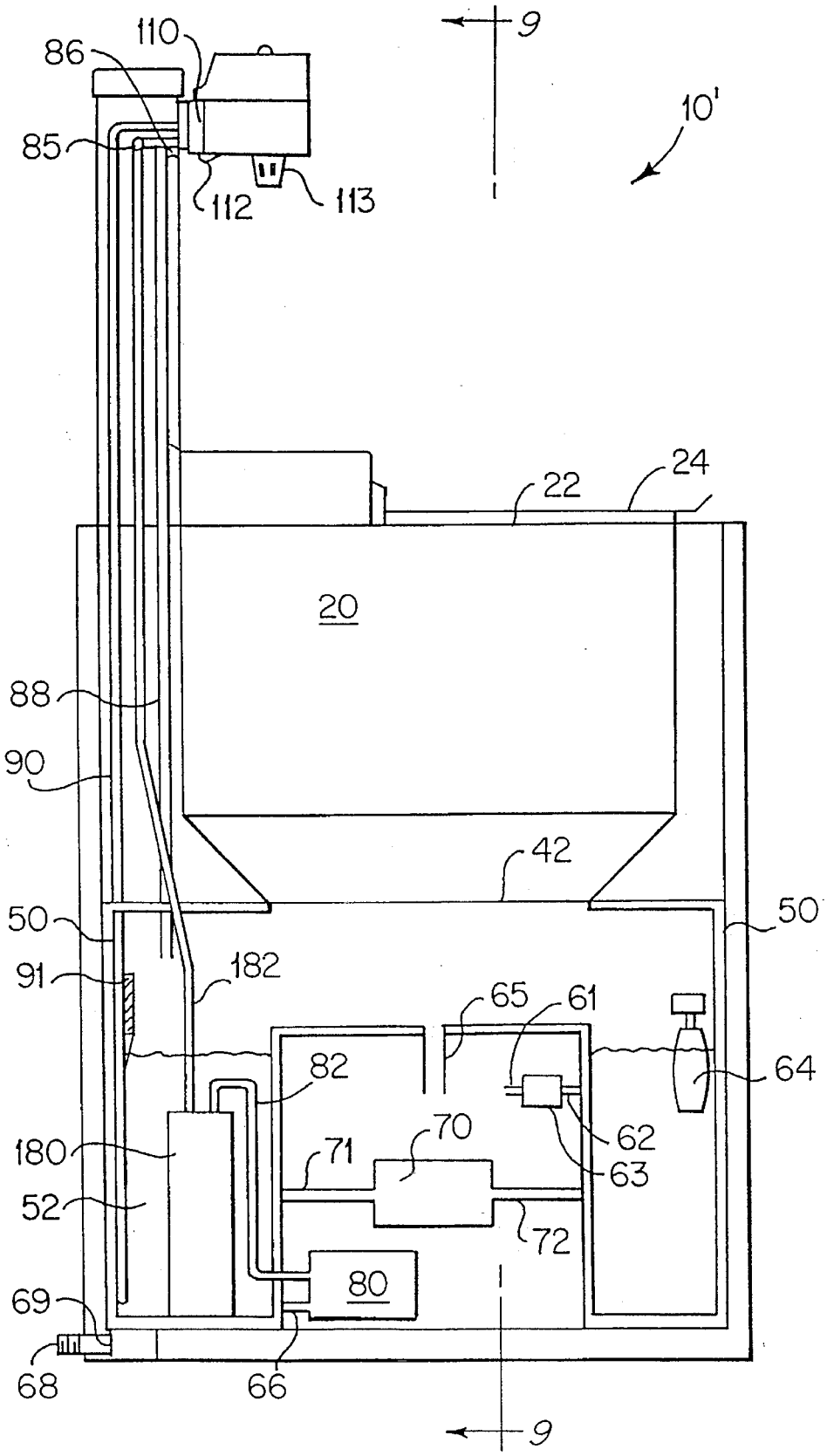
FIG. 8 is a sectional side view of an exemplary embodiment of an apparatus in accordance with an additional aspect of the present invention.
Figure 9:
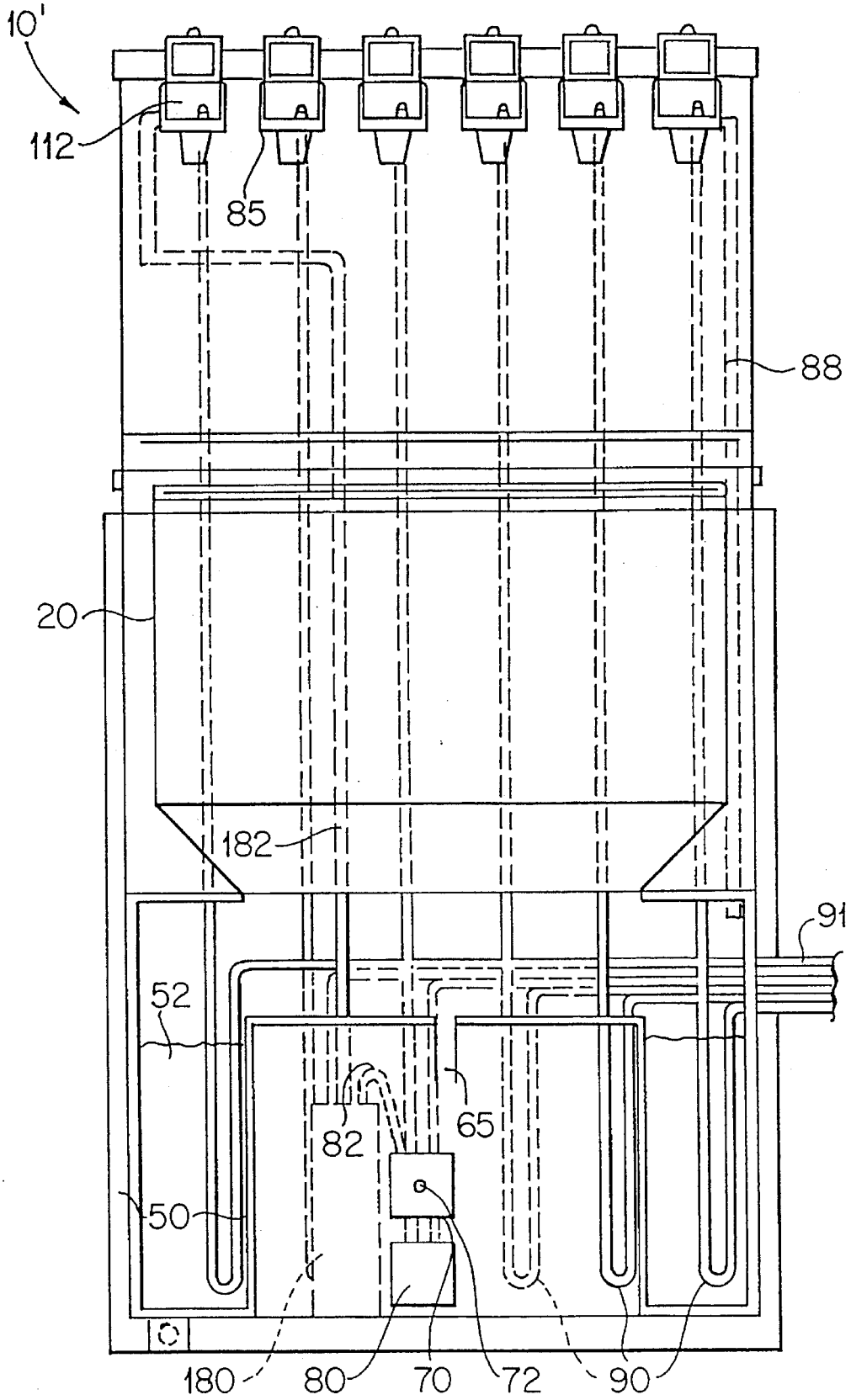
FIG. 9 is a sectional front view of the additional exemplary embodiment of FIG. 8, taken along line 9—9.

Although the beverage concentrate conduit and water discharge line arrangements of FIGS. 1 through 7 enhance the efficiency of the apparatus, other alternative arrangements may also be used. For example, FIGS. 8 through 9 show another exemplary embodiment of an apparatus in accordance with the present invention, generally designated by reference character 10', that is primarily located within a cabinet. This drop-in version of the present invention operates in substantially the same manner and generally includes all of the same features as the apparatus shown in FIGS. 1 through 5. However, to utilize a manual ice dispensing bin only the dispenser unit of the apparatus shown in FIGS. 8 through 9 is exposed above the counter top.

As with the apparatus of FIGS. 1 through 5, water from an outside source 61 is directly contacted with ice in the apparatus of FIGS. 8 through 9 to produce cooled heat exchanger water from the water and ice and an outflow of the cooled heat exchanger water. To conserve space and reduce costs, an ice transfer system as described above is not provided in this exemplary embodiment. Rather, ice is manually loaded through an ice bin opening 22 provided in the top of the ice bin 20 to fill the tank 52 provided at the bottom of the heat exchanger 50 through the ice inlet 42. An ice bin cover 24 closes the ice bin opening 22 to maintain the temperature within the ice bin 20, and to prevent foreign material from falling into the bin when closed. Water is then supplied from a water inlet 62, and controlled by a controlling system using a water level sensor 64 and a water inlet valve 63 in the same manner described above.

The apparatus of FIGS. 8 and 9 also includes a recirculation pump 70 for recirculating the heat exchanger water when a predetermined temperature is exceeded, as determined by a thermistor 74 and as described above, and a water pump 80 for drawing the outflow of cooled heat exchanger water through a water outlet 66 at the lower portion of the heat exchanger tank 52 for subsequent distribution and discharge through a water manifold 85. The recirculation pump 70 and the water pump 80 are positioned outside the heat exchanger tank 52.

Since the dispenser unit of this embodiment is located above the counter level, a length of the water line 182 from the water pump 80 to the water manifold 85 and of each beverage concentrate conduit 90 must extend outside of the heat exchanger tank 52 prior to reaching the corresponding dispensing valve 112. To maintain the temperature of the outflow of cooled heat exchanger water and the outflow of cooled beverage concentrate, insulative material is provided outside the heat exchanger tank 52 surrounding the water line 82, the water manifold 85, and the beverage concentrate conduits 90. As with the apparatus of FIGS. 2 through 5, a thermistor 89 and manifold recirculation valve 87 likewise can be provided to recirculate water from the water manifold 85 through a manifold recirculation line 88 to the heat exchanger tank 52 when the water in the manifold exceeds a predetermined temperature, such as during periods of low or casual demand. An orifice (not shown) also may be provided in the water manifold 85 for recirculating water at a low constant flow through a manifold recirculation line 88 to the heat exchanger tank 52 so as to prevent undesirable warming of the water in the manifold 85. In this manner, undesirably warm water is not mixed with a beverage concentrate or dispensed from the dispensing valve.

Although not shown, the heat exchanger of the drop-in version of the present invention also may include a second tank, as with the arrangements of FIGS. 6 and 7. In this manner, either ice and water together or cooled heat exchanger water alone can directly contact the beverage concentrate conduits to produce the outflow of cooled beverage concentrate without mixing into the outflow of cooled heat exchanger water from the first tank of the heat exchanger. This is accomplished by disposing the beverage concentrate conduit in the second tank. Hence, the cooled heat exchanger water from the first tank of the heat exchanger, which is used for producing the mixed beverage, does not contact the beverage concentrate conduits. The first and second tanks of the heat exchanger can be positioned in side-by-side or a front-to-back relationship with the beverage concentrate conduits configured accordingly.

Figure 10:
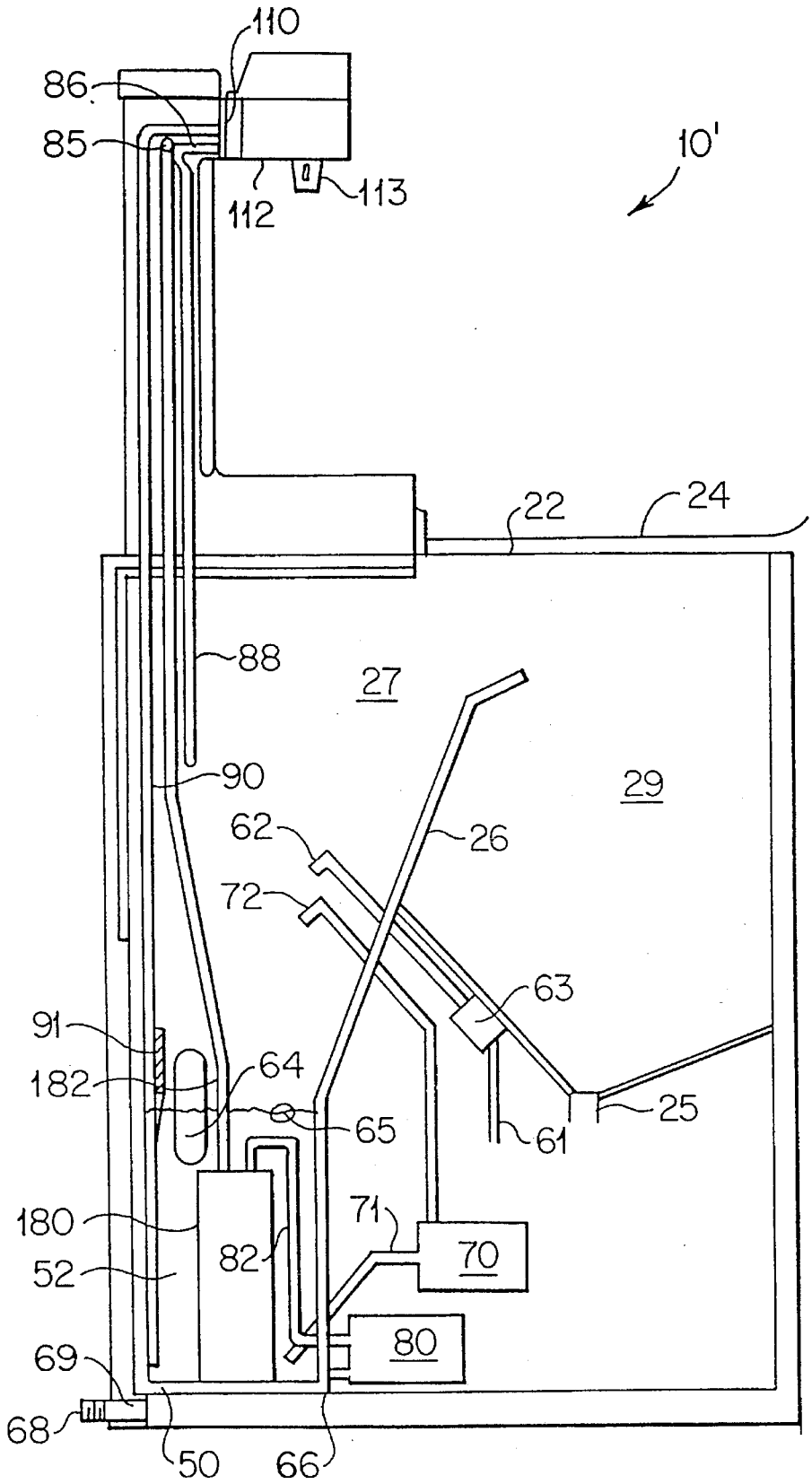
FIG. 10 is a sectional side view of an exemplary embodiment of an apparatus in accordance with yet a further aspect of the present invention.

The ice loaded into the ice bin 20 may be used for cooling the water supplied from the water inlet 62 to produce cooled heat exchanger water, and for filling beverage containers prior to dispensing the mixed beverage. To further enhance the purity of the outflow of cooled heat exchanger water, and in accordance with yet another aspect of the invention, the ice bin 20 may be configured to separate the ice that is used for producing the outflow of cooled heat exchanger water from the ice that is dispensed into beverage containers for consumption. For example, and as shown in FIG. 10, a dividing wall 26 may be provided to define a heat exchanger ice bin 27 and a dispenser ice bin 29. The melt runoff of the heat exchanger ice bin 27 mixes with the water from the water inlet 62 to produce the outflow of cooled heat exchanger water, while the melt runoff of the dispenser ice bin 29 is separately drained and discarded through the drain 25. Thus, the purity of the cooled heat exchanger water is further enhanced since outside contact with the ice in the heat exchanger ice bin 27 is minimized.

As previously mentioned, the present invention includes proportioning and mixing the outflow of cooled heat exchanger water and the outflow of cooled beverage concentrate to produce an outflow of cool, proportioned, mixed beverage. Accordingly, the apparatus of the present invention includes a proportioner and mixer for receiving the outflow of cooled heat exchanger water and the outflow of cooled beverage concentrate, and for proportioning and mixing the outflow of cooled heat exchanger water and the outflow of cooled beverage concentrate accordingly. Further, if the heat exchanger 50 includes two tanks 52', 54', as in the arrangement of FIG. 6, then the outflow of cooled heat exchanger water that is consumed is received solely from the first tank 52' of the heat exchanger 50.

When the beverage concentrate conduit includes a plurality of beverage concentrate conduits 90, as embodied herein, each beverage concentrate conduit 90 and corresponding water discharge line 86 is preferably provided with a separate proportioner and mixer. The proportioner and mixer thus proportion and mix the outflow of selected beverage concentrate and the outflow of cooled heat exchanger water to produce the selected cool, proportioned, mixed beverage.

A variety of conventional proportioners and mixers are known, and commonly available as an integral unit 110, as seen in FIGS. 1, 2, 4, and 7–10. Examples include such units as Flomatic 424, Lancer LEV, or Cornelius SF-1. The proportioner and mixer 110 may include pre-adjusted valves connected to the beverage concentrate conduit 90 and the water discharge line 86, respectively, to control or proportion the proper flow of the two liquids into a mixing chamber.

The purpose of the proportioner and mixer is to ensure that a proper ratio of the outflow of cooled beverage concentrate and the outflow of cooled heat exchanger water are mixed. This ratio affects the taste and quality of the mixed beverage, as well as the temperature in which the mixed beverage is dispensed. Preferably, the proportioner and mixer 110 are controlled to produce a cooled, proportioned, mixed beverage at a temperature of about 45° F. or below, and more preferably, at a temperature of about 40° F. or below, and most preferably, at a temperature of about 36° F. or below. Preferably, the control system described above properly proportions the water and ice in the heat exchanger and the duration of contact, as well as proportions the outflows of cooled beverage concentrate and cooled heat exchanger water, to produce the mixed beverage desired. For example, an outflow of cooled heat exchanger water having a temperature of about 36° F. is mixed with an outflow of cooled beverage concentrate having a temperature of about 38° F. at a volume ratio of between about 5:1 to produce a mixed beverage having a temperature of about 36° F.

A dispensing valve is also provided in accordance with the present invention for controlling the dispensing of the cool, proportioned, mixed beverage. Each dispensing valve 112 embodied herein and shown in FIGS. 1, 2, 4, and 7–10 is operated by a switch 111, shown in FIG. 1, such as toggle switch below a dispensing valve nozzle 113 or a separate push button switch. The switch 111 is operated, and the mixed beverage is dispensed through the dispensing valve 112 from the proportioner and mixer 110, when a container is positioned beneath the dispensing valve nozzle 113. The dispensing valve 112 also can be operated by an optical sensor or the like if desired.

Carbonated beverages are extremely popular, and commonly dispensed from beverage dispensers. If carbonation is desired, the apparatus preferably includes a carbonator for carbonating the outflow of cooled heat exchanger water which is used to produce the mixed beverage to be produced and dispensed. Since the solubility of carbon dioxide is inversely proportional to the temperature of the water that is to be carbonated, it is preferable to carbonate water at the lowest temperature possible above freezing. Once carbonated, it is further preferred that the carbonated water remain cool to prevent excessive release or foaming of carbon dioxide.

As embodied herein, the carbonator 180 is in heat exchange contact with cooled heat exchanger water for keeping the contents of the carbonator 180 cool. Specifically, FIGS. 2–5 and 8–10 show that the carbonator 180 is located in the lower portion of the heat exchanger tank 52 below the water level, and connected between the water pump 80 and the water manifold 85. Hence, the cooled heat exchanger water that is drawn through the water outlet 66 is pressurized by the water pump 80 and forced into the carbonator 180 so as to be carbonated with carbon dioxide supplied from a carbon dioxide source (not shown). By locating the carbonator 180 within the heat exchanger tank 52 below the water level, this arrangement maintains the low temperature of the water and stability of the carbonation.

Alternatively, when two heat exchanger tanks are provided, as shown in FIGS. 6 and 7, it is preferred that the carbonator 180 is located in the second tank 54' of the heat exchanger 50. This simplifies maintaining the purity of the cooled heat exchanger water from the first tank 52' of the heat exchanger 50, which is to be used for producing the mixed beverage.

In each preferred arrangement of the present invention, the cooled carbonated water is then released from the carbonator 180 for mixing with the outflow of cooled beverage concentrate. The cooled carbonated water may be directed through a water line 182 that is surrounded by ice and connected to a water manifold 85, as described above and shown in FIGS. 2 through 10. Alternatively, the carbonator 180 itself may be arranged to function as a manifold such that a separate water discharge line 86 corresponding to each beverage concentrate conduit 90 extends directly from the carbonator 180. A recirculation valve 87, such as conventional solenoid valve, or an orifice is also provided to recirculate the cooled carbonated water so a low temperature is maintained in the manifold 85, as previously described.

In accordance with the present invention, the cooled carbonated water is then directed to the proportioner and mixer 110 for proportioning and mixing with the outflow of cooled beverage concentrate in the manner described above. However, since the cooled beverage concentrate is cooled to a predetermined temperature, preferably within a 2° F. temperature difference of the cooled carbonated water, flashing of carbon dioxide from the carbonated water is minimized. Hence, by utilizing the method and apparatus described above, a mixed beverage can be cooled, prepared, and dispensed efficiently and inexpensively, and unnecessary waste of water and energy can be minimized.

It will be apparent to those skilled in the art that various modifications and variations can be made in the design and fabrication of the apparatus of the present invention, as well as the sequence and performance of the method of the present invention, without departing from the scope or spirit of the invention.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed:

1. A method for preparing and dispensing a cool beverage comprising:

contacting water and a plurality of pieces of ice directly together in a heat exchanger, cooling the water and melting the ice, to produce cooled heat exchanger water in the heat exchanger from the water and ice and an outflow of the cooled heat exchanger water;

flowing beverage concentrate through a conduit in thermal contact with said plurality of pieces of ice and said cooled heat exchanger water, indirectly contacting the beverage concentrate with the ice, melting the ice and cooling the beverage concentrate, to produce an outflow of the cooled beverage concentrate;

proportioning and mixing the outflow of cooled beverage concentrate with the outflow of said cooled heat exchanger water to produce a cool, proportioned, mixed beverage;

dispensing the cool, proportioned, mixed beverage.

2. The method of claim 1 including directly contacting the beverage concentrate conduit with at least a portion of the cooled heat exchanger water for thermal contact with the ice.

3. The method of claim 2 further including recycling the portion of the cooled heat exchanger water that directly contacts the beverage concentrate conduit so as to directly contact ice for continued cooling.

4. The method of claim 1, wherein the flowing step includes selectively flowing one of a plurality of beverage concentrates through one of a respective plurality of beverage concentrate conduits in thermal contact with the ice, indirectly contacting the beverage concentrates with the ice, cooling the beverage concentrates, to produce an outflow of the selected cooled beverage concentrate; and the proportioning and mixing step includes proportioning and mixing the outflow of selected cooled beverage concentrate with the outflow of cooled heat exchanger water to produce a selected cool, proportioned, mixed beverage.

5. The method of claim 4, wherein the plurality of beverage concentrates are cooled to a temperature within about 4° F. of each other.

6. The method of claim 4, wherein the plurality of beverage concentrates are cooled to a temperature within about 2° F. of each other.

7. The method of claim 1, wherein the outflow of cooled heat exchanger water and the outflow of cooled beverage concentrate are cooled to a temperature within about 4° F. of each other.

8. The method of claim 1, wherein the outflow of cooled heat exchanger water and the outflow of cooled beverage concentrate are cooled to a temperature within about 2° F. of each other.

9. The method of claim 1 including automatically maintaining sufficient water and ice in the heat exchanger to maintain the outflow of cooled heat exchanger water at a temperature of about 36° F. or below.

10. The method of claim 1 including maintaining the beverage concentrate in indirect contact with the ice a sufficient time to maintain the outflow of cooled beverage concentrate at a temperature of about 40° F. or below.

11. The method of claim 1 including carbonating the outflow of cooled heat exchanger water in a carbonator.

12. The method of claim 11 including operating the carbonator in heat exchange contact with the ice for keeping the contents of the carbonator cool.

13. The method of claim 12 including carbonating the outflow of cooled heat exchanger water in said carbonator and manifolding the carbonated water from the carbonator to individual conduits leading to a plurality of individual dispensing nozzles.

14. The method of claim 11 including recirculating carbonated water from the carbonator to the heat exchanger.

15. The method of claim 14 including controlling the recirculating with an orifice.

16. The method of claim 1, wherein the contacting step includes proportioning the water and ice and the duration of contact between the water and ice to produce the outflow of cooled heat exchanger water at a temperature of about 36° F. or below.

17. The method of claim 1, wherein the contacting step includes proportioning the water and ice and the duration of contact between the water and ice in the heat exchanger to produce cooled, proportioned, mixed beverage at a temperature of about 45° F. or below.

18. The method of claim 1, wherein the contacting step includes proportioning the water and ice and the duration of contact between the water and ice in the heat exchanger to produce cooled, proportioned, mixed beverage at a temperature of about 36° F. or below.

19. The method of claim 1, wherein the contacting step includes proportioning the water and ice and the duration of contact between the water and ice to produce the outflow of cooled beverage concentrate at a temperature of about 40° F. or below.

20. The method of claim 1, wherein the contacting step includes proportioning the water and ice and the duration of contact between the water and ice to produce the outflow of cooled beverage concentrate at a temperature of about 38° F. or below.

21. The method of claim 1, wherein the step of directly contacting water and ice in a heat exchanger includes directing the water along a path of sufficient length so as to be in contact with the ice a sufficient time to cool the water and melt the ice and produce the outflow of the cooled heat exchanger water at a temperature of about 36° F. or below.

22. The method of claim 21, wherein the directing includes agitating.

23. The method of claim 1 including automatically maintaining sufficient water and ice in the heat exchanger to maintain the outflow of cooled heat exchanger water at a substantially constant temperature independent of the rate of outflow.

24. The method of claim 1, wherein the contacting step includes proportioning the water and ice and the duration of contact between the water and ice to produce the outflow of cooled heat exchanger water at a temperature of about 38° F. or below.

25. The method of claim 1 including preventing any water and ice which directly contacts the beverage concentrate conduit from mixing with the cooled heat exchanger water.

26. The method of claim 1, wherein the flowing step includes flowing the beverage concentrate through a conduit which is an unencased tubular member.

27. An apparatus for preparing and dispensing a cool beverage comprising:

a heat exchanger having a tank for receiving and directly contacting water and a plurality of pieces of ice, cooling the water and melting the ice, to produce cooled heat exchanger water in the heat exchanger from the water and ice and an outflow of the cooled heat exchanger water;

a beverage concentrate conduit positioned within the heat exchanger for flowing a beverage concentrate therethrough and for thermally contacting said plurality of pieces of ice and said cooled heat exchanger water, indirectly contacting the beverage concentrate with the ice, melting the ice and cooling the beverage concentrate, to produce an outflow of the cooled beverage concentrate; and a proportioner and mixer for receiving the outflow of cooled heat exchanger water and the outflow of cooled beverage concentrate, and for proportioning and mixing the outflow of cooled heat exchanger water and the outflow of cooled beverage concentrate to produce a cool, proportioned, mixed beverage.

28. The apparatus of claim 27, wherein the beverage concentrate conduit is positioned to be directly contacting the cooled heat exchanger water.

29. The apparatus of claim 27, wherein the beverage concentrate conduit includes a plurality of beverage concentrate conduits for thermally contacting the ice, indirectly contacting a plurality of respective beverage concentrates with the ice, cooling the beverage concentrates, to produce an outflow of a selected cooled beverage concentrate; and the proportioner and mixer proportion and mix the outflow of selected beverage concentrate and the outflow of cooled heat exchanger water to produce a selected cool, proportioned, mixed beverage.

30. The apparatus of claim 29 including a carbonator for carbonating the outflow of cooled heat exchanger water and wherein the dispensing valve includes a plurality of dispensing valves for controlling the dispensing of a plurality of cool, proportioned, mixed beverages and a manifold and individual conduits for manifolding the carbonated water from the carbonator to the plurality of dispensing valves.

31. The apparatus of claim 27 including a control system for automatically maintaining sufficient water and ice in the heat exchanger to maintain the outflow of cooled heat exchanger water at a temperature of about 36° F. or below.

32. The apparatus of claim 27, wherein the beverage concentrate conduit is arranged so as to indirectly contact the beverage concentrate with the ice sufficient time to maintain the outflow of cooled beverage concentrate at a temperature of about 40° F. or below.

33. The apparatus of claim 27 including a carbonator for carbonating the outflow of cooled heat exchanger water.

34. The apparatus of claim 33, wherein the carbonator is in heat exchange contact with the ice for keeping the contents of the carbonator cool.

35. The apparatus of claim 33 including a conduit between the carbonator and heat exchanger for recirculating carbonated water from the carbonator to the heat exchanger.

36. The apparatus of claim 35 including an orifice for controlling the recirculating carbonated water.

37. The apparatus of claim 27, wherein the heat exchanger directs the water along a path of sufficient length so as to be in contact with the ice a sufficient time to cool the water and melt the ice and produce the outflow of the cooled heat exchanger water at a temperature of about 36° F. or below.

38. The apparatus of claim 37 including an agitator for agitating the water and ice in the heat exchanger.

39. The apparatus of claim 27 including a control system for automatically maintaining sufficient water and ice in the heat exchanger to maintain the outflow of cooled heat exchanger water at a substantially constant temperature independent of the rate of outflow.

40. The apparatus of claim 27 including a control system for proportioning the water and ice and the duration of contact between the water and ice in the heat exchanger to produce the outflow of cooled heat exchanger water at a temperature of about 38° F. or below.

41. The apparatus of claim 27 including a control system for proportioning the water and ice and the duration of contact between the water and ice in the heat exchanger to produce the outflow of cooled heat exchanger water at a temperature of about 36° F. or below.

42. The apparatus of claim 27 including a control system for proportioning the water and ice and the duration of contact between the water and ice in the heat exchanger to produce a cooled, proportioned, mixed beverage at a temperature of about 45° F. or below.

43. The apparatus of claim 27 including a control system for proportioning the water and ice and the duration of contact between the water and ice in the heat exchanger to produce a cooled, proportioned, mixed beverage at a temperature of about 40° F. or below.

44. The apparatus of claim 27 including a control system for proportioning the water and ice and the duration of contact between the water and ice in the heat exchanger to produce the outflow of cooled beverage concentrate at a temperature of about 40° F. or below.

45. The apparatus of claim 27 including a control system for proportioning the water and ice and the duration of contact between the water and ice in the heat exchanger to produce the outflow of cooled beverage concentrate at a temperature of about 38° F. or below.

46. An apparatus for preparing and dispensing a cool beverage comprising:

a heat exchanger having a tank for directly contacting water and ice, cooling the water and melting the ice, to produce cooled heat exchanger water in the heat exchanger from the water and ice and an outflow of the cooled heat exchanger water;

a beverage concentrate conduit positioned within the heat exchanger for flowing a beverage concentrate therethrough and for thermally contacting ice, indirectly contacting the beverage concentrate with the ice, melting the ice and cooling the beverage concentrate, to produce an outflow of the cooled beverage concentrate; and a proportioner and mixer for receiving the outflow of cooled heat exchanger water and the outflow of cooled beverage concentrate, and for proportioning and mixing the outflow of cooled heat exchanger water and the outflow of cooled beverage concentrate to produce a cool, proportioned, mixed beverage; and an ice storage bin communicable with the heat exchanger for supplying ice to the heat exchanger, a water inlet connected to the heat exchanger for supplying water to the heat exchanger, and outlet connected to the heat exchanger for outflowing the cooled heat exchanger water.

47. The apparatus of claim 46 including a water level sensor in the heat exchanger and a water inlet valve connected to the water level sensor and connected to the water inlet for maintaining a predetermined water level in the heat exchanger.

48. The apparatus of claim 46 including an ice transfer connected to the ice storage bin and to the heat exchanger for transferring ice from the bin to the heat exchanger.

49. The apparatus of claim 46 including a pump having an intake connected to the cooled heat exchanger water outlet for pumping and providing pressure to the cooled heat exchanger water from the heat exchanger.

50. The apparatus of claim 49 including a carbonator connected to the pump for carbonating cooled heat exchanger water delivered by the pump.

51. The apparatus of claim 50, wherein the carbonator is positioned in heat exchange contact with the ice for maintaining cold carbonated water in the carbonator.

52. The apparatus of claim 50, wherein the carbonator is positioned in the tank of the heat exchanger in direct contact with the cooled heat exchanger water for maintaining cold carbonated water in the carbonator.

53. The apparatus of claim 27, wherein the beverage concentrate conduit is disposed within the tank of the heat exchanger in direct contact with the cooled heat exchanger water.

54. The apparatus of claim 53, wherein the beverage concentrate conduit is an unencased tube.

55. The apparatus of claim 27, wherein the beverage concentrate conduit is positioned to be prevented from directly contacting the cooled heat exchanger water produced in the tank.

56. An apparatus for preparing and dispensing a cool beverage comprising:

a heat exchanger having a tank for directly contacting water and ice, cooling the water and melting the ice, to produce cooled heat exchanger water in the heat exchanger from the water and ice and an outflow of the cooled heat exchanger water;

a beverage concentrate conduit positioned within the heat exchanger for flowing a beverage concentrate therethrough and for thermally contacting ice, indirectly contacting the beverage concentrate with the ice melting the ice and cooling the beverage concentrate; to produce an outflow of the cooled beverage concentrate; and a proportioner and mixer for receiving the outflow of cooled heat exchanger water and the outflow of cooled beverage concentrate, and for proportioning and mixing the outflow of cooled heat exchanger water and the outflow of cooled beverage concentrate to produce a cool, proportioned, mixed beverage;

wherein the heat exchanger includes a second tank, and the beverage concentrate conduit is positioned in the second tank of the heat exchanger to be disposed in direct contact with water and ice in the second tank while preventing the water and ice in the second tank from mixing into the cooled heat exchanger water out-flowed from the first tank of the heat exchanger.

57. The apparatus of claim 56, wherein the heat exchanger includes an additional tank, and second beverage concentrate conduit is positioned in the additional tank of the heat exchanger to be disposed in direct contact with a portion of the cooled heat exchanger water cycled from the second tank to produce the outflow of cooled beverage concentrate.

58. The apparatus of claim 57 further including a pump for recycling the portion of cooled heat exchanger water from the additional tank back to the second tank so as to directly contact the recycled portion of the cooled heat exchanger water with the ice for continued cooling.

59. An apparatus for preparing and dispensing a cool beverage comprising:

a heat exchanger having a first tank for directly contacting water and ice, cooling the water and melting the ice, to produce cooled heat exchanger water in the heat exchanger from the water and ice and an outflow of the cooled heat exchanger water;

a beverage concentrate conduit positioned within the heat exchanger for flowing a beverage concentrate therethrough and for thermally contacting ice, indirectly contacting the beverage concentrate with the ice, melting the ice and cooling the beverage concentrate, to produce an outflow of the cooled beverage concentrate; and a proportioner and mixer for receiving the outflow of cooled heat exchanger water and the outflow of cooled beverage concentrate, and for proportioning and mixing the outflow of cooled heat exchanger water and the outflow of cooled beverage concentrate to produce a cool, proportioned, mixed beverage;

wherein the heat exchanger includes an additional tank, and a beverage concentrate conduit is positioned in the additional tank of the heat exchanger to be disposed in direct contact with a portion of the cooled heat exchanger water cycled from the first tank to produce the outflow of cooled beverage concentrate.

60. An apparatus for preparing and dispensing a cool beverage comprising:

a first heat exchanger tank for receiving and directly contacting water and a plurality of pieces of ice, cooling the water and melting the ice, to produce cooled heat exchanger water;

a second heat exchanger tank including a beverage concentrate conduit for flowing a beverage concentrate therethrough, the second heat exchanger tank for directly contacting the beverage concentrate conduit with a portion of said cooled heat exchanger water and indirectly contacting the beverage concentrate with the portion of said cooled heat exchanger water to produce an outflow of cooled beverage concentrate;

means for transferring said portion of cooled heat exchanger water from said first heat exchanger tank to said second heat exchanger tank; and a proportioner and mixer for receiving a water flow and said outflow of cooled beverage concentrate, and for proportioning and mixing the water flow and the outflow of cooled beverage concentrate to produce a cool, proportioned, mixed beverage.

61. The apparatus of claim 60, wherein the transfer means includes a pump.

62. The apparatus of claim 61, wherein the pump recirculates the cooled heat exchanger water from the second heat exchanger tank back to the first heat exchanger tank.

63. The apparatus of claim 60, wherein the beverage concentrate conduit includes a plurality of beverage concentrate conduits for directly contacting the portion of said cooled heat exchanger water and indirectly contacting a plurality of respective beverage concentrates with the portion of said cooled heat exchanger water to produce an outflow of selected cooled beverage concentrates.

64. The apparatus of claim 60, wherein the first heat exchanger tank includes a water level relief outlet at a desired level of the cooled heat exchanger water for preventing the cooled heat exchanger water in the first heat exchanger tank from exceeding the desired level.

65. The apparatus of claim 60, including an ice storage bin for supplying ice to the first heat exchanger tank.

66. The apparatus of claim 60, wherein the beverage concentrate conduit has its greatest cooled length within the second heat exchanger tank.

67. The apparatus of claim 60 including a dispensing valve, wherein, the beverage concentrate conduit is arranged to exit the second heat exchanger tank immediately behind the dispensing valve to minimize the duration in which the cooled beverage concentrate is not cooled with the second heat exchanger tank.

68. The apparatus of claim 60, wherein the beverage concentrate conduit is first cooled within the second heat exchanger tank.

69. The apparatus of claim 60, wherein the beverage concentrate conduit has a coiled configuration solely in the second heat exchanger tank.

70. The apparatus of claim 60, wherein the beverage concentrate conduit has a coiled configuration in the second heat exchanger tank.

71. The apparatus of claim 60 including an ice making machine positioned outside the first and second tanks heat exchanger for making ice supplied to the first heat exchanger tank.

72. The apparatus of claim 71, wherein the ice making machine makes cubed ice.

73. A method for preparing and dispensing a cool beverage comprising:

contacting water and a plurality of pieces of ice directly together in a first heat exchanger tank, cooling the water and melting the plurality of pieces of ice, to produce cooled heat exchanger water;

transferring a portion of the cooled heat exchanger water from the first heat exchanger tank to a second heat exchanger tank;

flowing a beverage concentrate through a beverage concentrate conduit in the second heat exchanger tank, directly contacting the beverage concentrate conduit with the portion of the cooled heat exchanger water and indirectly contacting the beverage concentrate with the portion of the cooled heat exchanger water to produce an outflow of cooled beverage concentrate;

proportioning and mixing a water flow and the outflow of the cooled beverage concentrate to produce a cool, proportioned, mixed beverage; and dispensing the cool, proportioned, mixed beverage.

74. The method of claim 73, wherein the transfer step includes transferring the portion of the cooled heat exchanger water from the first heat exchanger tank to the second heat exchanger tank by a pump.

75. The method of claim 73, wherein the flowing step includes flowing a plurality of beverage concentrates through a plurality of respective beverage concentrate conduits in the second heat exchanger tank, directly contacting the plurality of beverage concentrate conduits with the portion of the cooled heat exchanger water and indirectly contacting the plurality of beverage concentrates with the portion of the cooled heat exchanger water to produce an outflow of selected cooled beverage concentrates.

76. The method of claim 73 including preventing the cooled heat exchanger water in the first heat exchanger tank from exceeding a desired level by flowing water through a water level relief outlet located in the first heat exchanger tank at the desired level of the cooled heat exchanger water.

77. The method of claim 73 including supplying ice to the first heat exchanger tank from an ice storage bin.

78. The method of claim 73, wherein said plurality of pieces of ice include ice cubes.

79. The apparatus of claim 60 wherein said plurality of pieces of ice include ice cubes.

80. The method of claim 73, wherein the beverage concentrate is flowed through a beverage concentrate conduit having a coiled configuration.

81. The method of claim 73, wherein the beverage concentrate is flowed through a beverage concentrate conduit having a coiled configuration solely in the second heat exchanger tank.

82. The method of claim 73, wherein the beverage concentrate conduit is first cooled within the second heat exchanger tank.

83. The method of claim 73, wherein the beverage concentrate conduit has its greatest cooled length within the second heat exchanger tank.

84. The method of claim 73, wherein the beverage concentrate is flowed through beverage concentrate conduits exiting the second heat exchanger tank immediately behind dispensing valves to minimize the duration in which the cooled beverage concentrate is not cooled within the second heat exchanger tank.

85. The method of claim 73 including making ice outside the first heat exchanger and second tanks and supplying the ice made outside the first and second heat exchanger to the first heat exchanger tank.

86. The method of claim 85, wherein the ice made outside the first and second heat exchanger tanks is cubed ice.

87. An apparatus for preparing and dispensing a cool beverage from a plurality of components including water and a beverage concentrate comprising:

a first heat exchanger tank for receiving and directly contacting water and a plurality of pieces of ice, cooling the water and melting the ice, to produce cooled heat exchanger water;

a second heat exchanger tank including at least one conduit for flowing at least one of the components therethrough, the second heat exchanger tank for directly contacting the at least one conduit with a portion of said cooled heat exchanger water and indirectly contacting the at least one component with the portion of said cooled heat exchanger water to produce an outflow of cooled component;

means for transferring said portion of cooled heat exchanger water from said first heat exchanger tank to said second heat exchanger tank; and a proportioned and mixer for receiving the plurality of components and said outflow of cooled component, and for proportioning and mixing the plurality of components and the outflow of cooled component to produce a cool, proportioned, mixed beverage.

88. A method for preparing and dispensing a cool beverage from a plurality of components including water and a beverage concentrate comprising:

contacting water and a plurality of pieces of ice directly together in a first heat exchanger tank, cooling the water and the melting the plurality of pieces of ice, to produce cooled heat exchanger water;

transferring a portion of the cooled heat exchanger water from the first heat exchanger tank to a second heat exchanger tank;

flowing at least one component through at least one conduit in the second heat exchanger tank, directly contacting the at least one conduit with the portion of the cooled heat exchanger water and indirectly contacting the at least one component with the portion of the cooled heat exchanger water to produce an outflow of cooled component;

proportioning and mixing the plurality of components and the outflow of the cooled component to produce a cool, proportioned, mixed beverage; and dispensing the cool, proportioned, mixed beverage.

89. A method for preparing and dispensing a cool beverage comprising:

supplying ice from an ice bin to both a heat exchanger, and an ice dispenser;

contacting water and the ice directly together in the heat exchanger, cooling the water and melting the ice, to produce cooled heat exchanger water in the heat exchanger from the water and ice and an outflow of the cooled heat exchanger water;

flowing beverage concentrate through a conduit in thermal contact with the ice, indirectly contacting the beverage concentrate with the ice melting the ice and cooling the beverage concentrate, to produce an outflow of the cooled beverage concentrate;

proportioning and mixing the outflow of cooled beverage concentrate with the outflow of cooled heat exchanger water to produce a cool, proportioned, mixed beverage;

dispensing the cool, proportioned, mixed beverage in a dispensing area; and dispensing ice from the ice dispenser in the dispensing area.

90. An apparatus for preparing and dispensing a cool beverage comprising:

a heat exchanger having a tank for directly contacting water and ice, cooling the water and melting the ice, to produce cooled heat exchanger water in the heat exchanger from the water and ice and an outflow of the cooled heat exchanger water;

a beverage concentrate conduit positioned within the heat exchanger for flowing a beverage concentrate therethrough and for thermally contacting the ice, indirectly contacting the beverage concentrate with the ice, melting the ice and cooling the beverage concentrate, to produce an outflow of the cooled beverage concentrate;

a proportioner and mixer for receiving the outflow of cooled heat exchanger water and the outflow of cooled beverage concentrate, and for proportioning and mixing the outflow of cooled heat exchanger water and the outflow of cooled beverage concentrate to produce a cool, proportioned, mixed beverage;

a dispensing area including an ice dispenser for dispensing ice, and a plurality of dispensing outlets including a dispensing valve for dispensing the cool, proportional, mixed beverage; and an ice bin for supplying the ice to both the heat exchanger and the ice dispenser.

* * * * *

UNITED STATES PATENT AND TRADEMARK OFFICE

CERTIFICATE OF CORRECTION

PATENT NO. : 5,549,219

DATED : August 27, 1996

INVENTOR(S) : William G. LANCASTER

It is certified that error appears in the above-indentified patent and that said Letters Patent is hereby corrected as shown below:

Claim 32, col. 16, line 48, insert --a-- before "sufficient".

Claim 56, col. 18, lines 35-36, "ice melting" should read --ice, melting--;
line 36, "concentrate; to" should read --concentrate, to--.

Claim 57, col. 18, line 54, insert --a-- before "second".

Claim 67, col. 20, line 2, "wherein, the" should read --wherein the--.

Claim 71, col. 20, lines 16-17, "first and second tanks heat exchanger" should read --first and second heat exchanger tanks--.

Claim 85, col. 21, line 18, "first heat exchanger and second tanks" should read --first and second heat exchanger tanks--;
line 19, insert --tanks-- after "exchanger".

Claim 87, col. 21, line 42, "proportioned" should read --proportioner--.

Claim 89, col. 22, line 22, "ice melting" should read --ice, melting--.

Signed and Sealed this

Twenty-sixth Day of November 1996

*Attest:*

*Attesting Officer*

BRUCE LEHMAN

*Commissioner of Patents and Trademarks*